United States Patent [19]

Benham

[11] 4,331,290

[45] May 25, 1982

[54] MULTIPLE POCKET, EXPANDABLE ENVELOPE, AND BLANK AND METHOD FOR FORMING SAME

[75] Inventor: Albert A. Benham, Granville, Mass.

[73] Assignee: Champion International Corporation, Stamford, Conn.

[21] Appl. No.: 188,366

[22] Filed: Sep. 18, 1980

[51] Int. Cl.[3] ..... B65D 27/08

[52] U.S. Cl. ..... 229/72; 229/DIG. 3; 493/244; 493/246; 493/261; 493/267

[58] Field of Search ..... 229/68 R, 72, 56, 1.5 R, 229/DIG. 3; 493/244, 246, 261, 267, 264

[56] References Cited

U.S. PATENT DOCUMENTS

| | | | |
|---|---|---|---|
| 763,797 | 6/1904 | Rueve, Jr. | 229/68 R |
| 979,213 | 12/1910 | Shedd | 229/68 R |
| 1,202,069 | 10/1916 | Kantro | 229/72 |
| 1,421,240 | 6/1922 | Ikeda et al. | 229/72 |
| 1,586,016 | 5/1926 | Walters | 229/72 |
| 2,108,343 | 2/1938 | McAllister | 229/68 R |
| 2,416,816 | 3/1947 | Campagnano | 229/72 |
| 3,113,573 | 12/1963 | Schler | 229/68 R |

*Primary Examiner*—Stephen P. Garbe
*Attorney, Agent, or Firm*—Evelyn M. Sommer

[57] ABSTRACT

A multiple pocket, expandable envelope is formed by folding panels of a planar, unitary blank relative to each other. The envelope has two pair of front and back panels hingedly coupled along a common end edge. Each front and back panel includes a front and back divider panel therebetween to define six pockets within the envelope. Each front panel is hingedly coupled to a front divider panel along a fold line at one side thereof. Each back panel is hingedly coupled to a back divider panel along a fold line at one side thereof. A plurality of side panels hingedly couple each front panel to a front divider panel at the other side of the front panel, each back panel to a back divider panel at the other side of the back panel, and the front and back divider panels at each pair to each other. One of the front panels in each pair is hingedly coupled to one of the back panels in an adjacent pair to form the six-pocket, expandable envelope.

12 Claims, 11 Drawing Figures

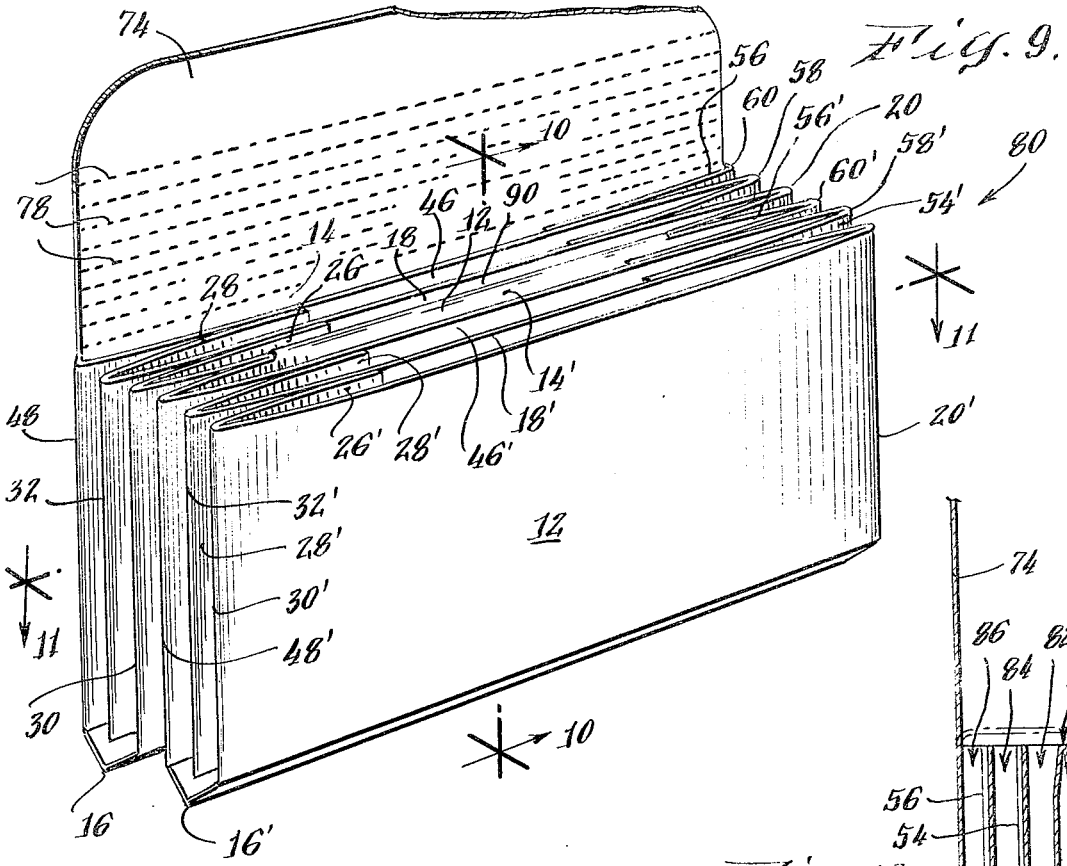
Fig. 9.
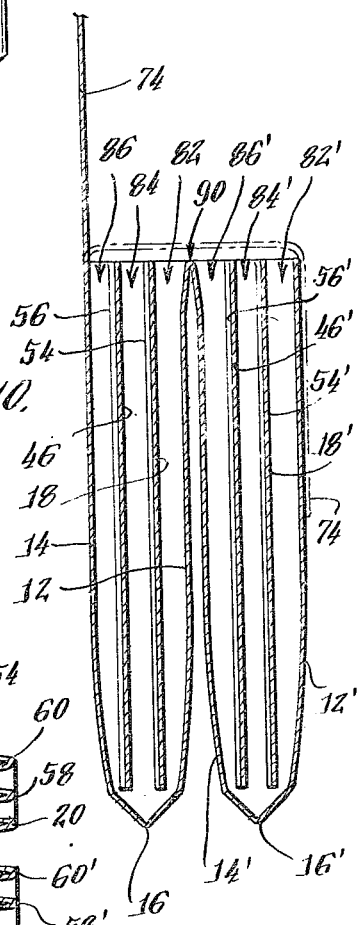
Fig. 10.
Fig. 11.
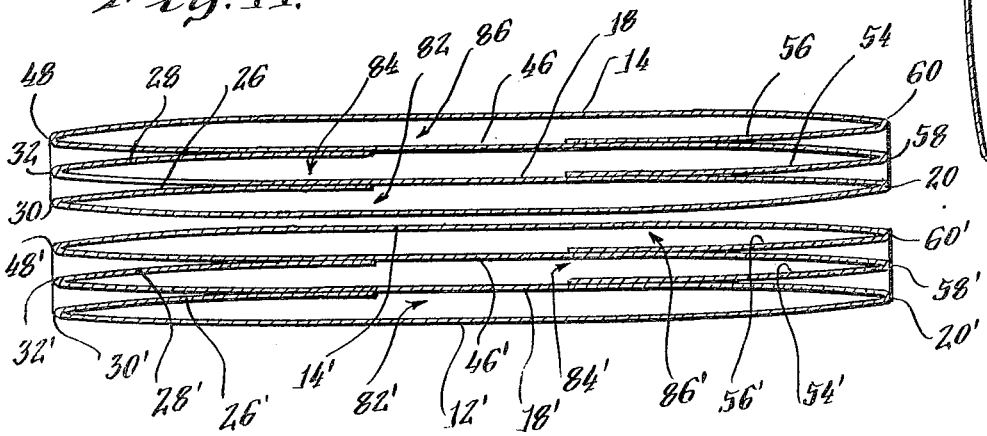

MULTIPLE POCKET, EXPANDABLE ENVELOPE, AND BLANK AND METHOD FOR FORMING SAME

BACKGROUND OF THE INVENTION

The present invention relates to a multiple pocket, expandable envelope, a blank for forming a multiple pocket, expandable envelope, and a method of forming a multiple pocket, expandable envelope from a blank. More particularly, the invention relates to the use of a planar, unitary blank for forming a multiple pocket, expandable envelope which may be folded simply and inexpensively in a one-pass, right angle gluing and folding operation.

In constructing envelopes or folders, it is often necessary to provide a plurality of individual pockets or compartments for separating the contents of the envelope. Additionally, the envelope must be capable of being shipped and stored in a flat, collapsed configuration to use shipping and storage space efficiently, and then expanded to receive varying amounts of contents, e.g. sheets of paper.

Conventional multiple pocket envelopes or folders are formed from a plurality of components which are automatically and manually assembled. The forming of such envelopes from a plurality of components is difficult and expensive, involving both manual steps and complex machinery.

To form multiple pocket, expandable envelopes simply, inexpensively and efficiently, such envelopes must be formed from a planar, unitary blank which may be folded and glued in a one-pass, right angle gluing and folding operation. Such operation eliminates manual handling and permits the envelope to be manufactured on relatively simple, conventional folding and gluing apparatus.

SUMMARY OF THE INVENTION

Accordingly, it is an object of the present invention to provide a multiple pocket, expandable envelope, and blank and method for forming same employing a planar unitary blank which may be simply and inexpensively formed in a one-pass, right angle gluing and folding operation on conventional folding and gluing apparatus.

Another object of the present invention is to provide a multiple pocket, expandable envelope which is of rugged construction and is easily adapted to various shapes and sizes and different numbers of pockets.

The foregoing objects are attained by providing a multiple pocket, expandable envelope formed from a planar, unitary blank comprising two pair of front and back panels having opposed end edges and opposed first and second side edges. Each pair of front and back panels are hingedly coupled at adjacent end edges thereof along a fold line. Front and back divider panels each having opposed first and second side edges and opposed first and second surfaces are also provided for each pair of front and back panels. The front and back divider panels are hingedly coupled at the first side edges thereof to the front and back panels, respectively, in each pair. First means hingedly couple the front panel at the second side edge thereof to the front divider panel, second means hingedly couple the front and back divider panels, in each pair, and third means hingedly couple the back panel in each pair at the second side edge thereof to the back divider panel.

The foregoing objects are also attained by a planar, unitary blank for forming a multiple pocket, expandable envelope, comprising two pair of front and back panels each having opposed end edges and opposed first and second side edges. The front and back panels in each pair are hingedly coupled at adjacent end edges thereof along a fold line, a front divider panel hingedly coupled at one of the front panel side edges along a fold line, first and second front side panels hingedly coupled at the other of the front panel side edges and at a side edge of the front divider panel remote from the front panel, respectively, along fold lines, a back divider panel hingedly coupled at one of the back panel side edges along a fold line, and first and second back side panels hingedly coupled at a side edge of the back divider panel remote from the back panel and at the other of the back panel side edges, respectively, along fold lines. Each pair of front and back panels are hingedly coupled along a common end edge between one of the front and back panels in each pair of panels.

The foregoing objects are additionally attained by a method of forming a multiple pocket, expandable envelope, comprising forming a planar, unitary blank as set forth in the paragraph immediately above, folding the first side panel and the second back side panel to overlie interior surfaces of the front and back panels, respectively, in each pair about the respective fold lines therebetween, folding the front and back divider panels to overlie the front panel and first front side panel and the back panel and second back side panel, respectively, about the respective fold lines therebetween, in each pair and fixing the first front side panel and the second back side panel to adjacent surfaces of the front and back divider panels, respectively, folding the second front side panel and the first back side panel to overlie interior surfaces of the front and back divider panels, respectively, about the respective fold lines therebetween, and folding the front and front divider panels relative to the back and back divider panels about the fold line between the front panel and the back panel, and fixing the second front side panel and the first back side panel to adjacent surfaces of the back and front divider panels, respectively, in each pair. Then, the pairs of front and back panels are folded 180° relative to each other about the common end edge joining the pairs of panels.

By forming the envelope and blank and by performing the method of the present invention in this manner, a multiple pocket, expandable envelope may be simply and inexpensively formed from a planar, unitary blank in a one-pass, right angle folding and gluing operation. This permits the envelope to be formed automatically without manual handling on conventional right angle folding and gluing apparatus. Thereby, the problems associated with forming conventional multiple pocket envelopes comprising many separate components are eliminated.

Other objects, advantages and salient features of the present invention will become apparent from the following detailed description, which taken in conjunction with the annexed drawings, discloses a preferred embodiment of the present invention.

As used in this application, the terms "first", "second", "front", "back", "side", and "end", are intended to facilitate the description of the envelope and the blank for forming the envelope. Thus, such terms are merely illustrative of the envelope and blank and are not intended to limit the envelope or blank to any specific orientation. The terms, "interior" and "exterior", describe surfaces which face toward and away from, respectively, a plane passing through the center of the assembled envelope and generally parallel to the front and back panels.

BRIEF DESCRIPTION OF THE DRAWINGS

Further objects and advantages of the present invention will become apparent from the following description and claims and from the accompanying drawings, wherein:

FIG. 9 is a perspective view illustrating a multiple pocket, expandable envelope in accordance with the present invention which has been folded from the blank of FIG. 1;

FIG. 10 is a cross-sectional view taken substantially along the plane indicated by lines 10—10 of FIG. 9; and FIG. 11 is a cross-sectional view taken substantially along the plane indicated by line 11—11 of FIG. 9.

DETAILED DESCRIPTION OF THE PREFERRED EMBODIMENT OF THE INVENTION

Figure 1:
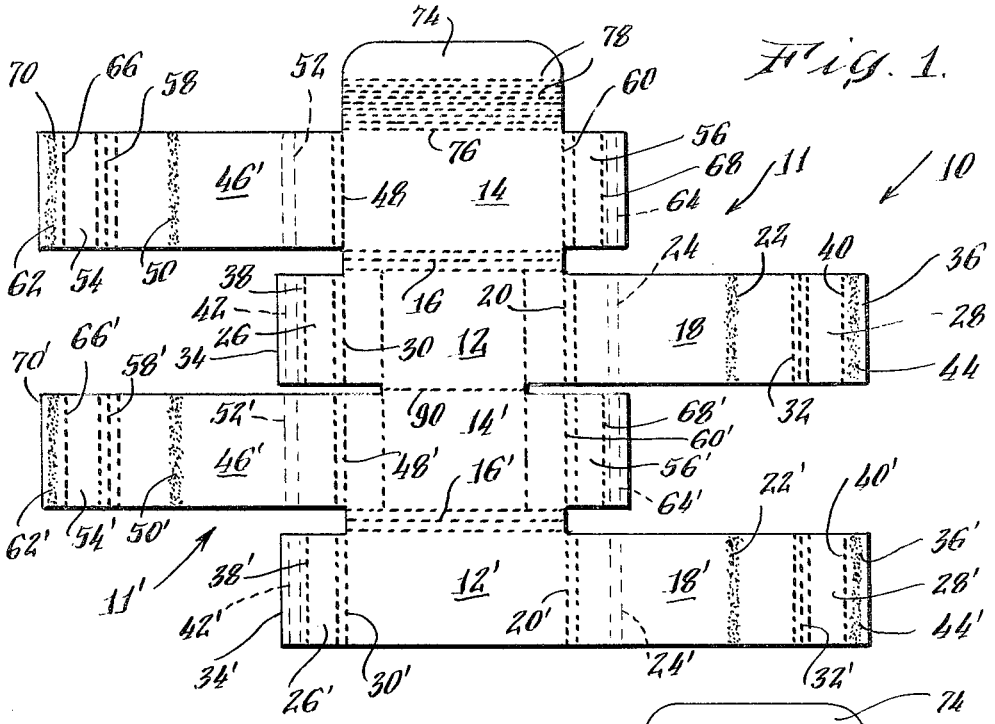
FIG. 1 is a plan view illustrating a blank for forming an envelope in accordance with the present invention.

Referring now to the drawings in detail, wherein like numerals indicate like elements throughout the several views and particularly to FIG. 1, the blank 10 may be formed of a planar, unitary piece of paperboard of suitable weight and thickness. The weight and thickness of the paper depends on the size of the envelope or folder to be formed and the weight of the article to be placed within the envelope. The blank 10 comprises two identical portions 11 and 11' joined by a fold line or common edge 90. For purposes of description, the portion 11 will be described in detail, it being understood that the portion 11' and the elements designated by primed numerals operate and are identical to those elements indicated by like, unprimed numerals in portion 11.

The upper portion of the blank 10 comprises a front panel 12 and a back panel 14, joined by edge 90 to an identical front panel 12' and to panel 14'. The front and back panels of each pair are generally rectangular in shape and equal in size; however, it should be noted that such panels may be of any suitable configuration and relative size. Each of the front and back panels 12, 14; (12', 14') has opposed end edges which extend horizontally across the paper in FIG. 1 and opposed first and second side edges which extend vertically in FIG. 1. The front and back panels 12, 14; (12', 14') of each pair are hingedly coupled along adjacent end edges thereof along a fold line 16 (16'). In FIG. 1, the interior surfaces of the front and back panels 12, 14; (12', 14') are illustrated.

A front divider panel 18, (18') extends from one side edge of each front panel 12, (12'), and is hingedly coupled thereto along a fold line 20, (20'). The front divider panel 18, (18') is generally rectangular in shape and substantially equal in size to the front panel 12, (12'). However, the panel 18, (18') may be of any suitable configuration and size. In FIG. 1, the exterior surface of the front divider panel 18, (18') is illustrated. A glue area 22, (22') is provided on the exterior surface of the front divider panel 18, (18') adjacent, but spaced from, the side edge thereof remote from the front panel 12, (12'). A glue area 24, (24') is provided on the interior surface of the front divider panel 18, (18') adjacent, but spaced from, the fold line 20, (20').

Front side panels 26, 28, (26', 28') extend from the front panel 12, (12') and the front divider panel 18, (18'), respectively. The first front side panel 26, (26') is hingedly coupled to the other side edge of the front panel 12, (12') along a fold line 30, (30'). The second front side panel 28, (28') is hingedly coupled at the side edge of the front divider panel 18, (18') remote from the front panel 12, (12') along a fold line 32, (32'). The side panels 26, 28, (26', 28') are generally rectangular in configuration.

Glue flaps 34, 36, (34', 36') extend from the side panels 26, 28, (26', 28'), respectively. The first front glue flap 34, (34') is hingedly coupled at its longer parallel side to the side edge of the first front side panel 26, (26') remote from the front panel 12, (12') along a fold line 38, (38'). Similarly, the second front glue flap 36, (36') is hingedly coupled at its longer parallel edge to the side edge of the second front side panel 28, (28') remote from the front divider panel 18, (18') along a fold line 40, (40'). One surface (interior) of the first front glue flap 34, (34') has a glue area 42, (42') while an opposite surface (exterior) of the second front glue flap 36, (36') has a glue area 44, (44').

The back panel 14, (14') has a back divider panel 46, (46') hingedly coupled at adjacent side edges thereof along a fold line 48, (48'). The back divider panel 46, (46') is generally rectangular and of substantially the same size as the back panel 14, (14'); however, it may be of any suitable size or configuration. The fold lines 30, 48, (30', 48') are colinear. A glue area 50, (50') is provided on the exterior surface (i.e., that surface illustrated in FIG. 1) of the back divider panel 46, (46') adjacent, but spaced from, the side edge of the back divider panel 46, (46') remote from the back panel 14, (14'). A glue area 52, (52') is provided on the interior surface of the back divider panel 45, (46') adjacent, but spaced from, the back panel 14, (14') and the fold line 48, (48').

Back side panels 54, 56, (54', 56') extend from the free side edges of the back divider panel 46, (46') and the back panel 14, (14'), respectively. The back side panels 54, 56 (54', 56') are generally rectangular in shape. The first back side panel 54, (54') is hingedly coupled to the side edge of the back divider panel 46, (46') remote from the back panel 14, (14') along a fold line 58, (58'). The second back side panel 56, (56') is hingedly coupled to the other side edge of the back panel 14, (14') along a fold line 60, (60'). The fold lines 60, 20, (60', 20') are colinear. The first front side panel 26, (26') and the back divider panel 46, (46') as well as the front divider panel 18, (18') and the second back side panel 45, (45') are separated to permit them to be folded independently.

Glue flaps 62, 64, (62', 64') extend from the back side panels 54, 56, (54', 56'), respectively. The first back glue flap 52, (52') is hingedly coupled at its longer parallel side to a side edge of the first back side panel 54, (54') remote from the back divider panel 46, (46') along a fold line 66, (66'). The second back glue flap 64, (64') is hingedly coupled at its longer parallel side edge to the side edge of the second back side panel 56, (56') remote from the back panel 14, (14') along a fold line 68, (68'). One surface (exterior) of the first back glue flap 62, (62') has a glue area 70, (70') while an opposite surface (interior) of the second back glue flap 64, (64') has a glue area 72, (72').

The glue areas 22, 24, 50, 52, (22', 24', 50', 52') and glue areas 42, 70, 44, (42', 70', 44'), respectively, are shaped and oriented to mate. The glue areas 22, 24, (22', 24') on front divider panel 18, (18') are spaced from fold lines 32, 20, (32', 20'), respectively, at distances equal to the spacing of glue areas 42, 70, (42', 70') from fold lines 30, 58, (30', 58'), respectively. The glue areas 50, 52, (50', 52') on back divider panel 46, (46') are spaced from fold lines 58, 48, (58', 48'), respectively, at distances equal to the spacing of glue areas 72, 44, (72', 44') from fold lines 50, 32, (50', 32'), respectively.

A top flap 74 of generally rectangular configuration is hingedly coupled to the end edge of the back panel 14 remote from the front panel 12 along a fold line 76. The top flap 74 includes a series of parallel fold lines 78 to facilitate folding of the top flap 74 at various expanded extents of the envelope. The base of the top flap 74 is oriented along the fold line 76.

The envelope 80 (illustrated in FIGS. 9 to 11 is formed from the blank 10 of FIG. 1 by folding the first front side panel 26, (26') about the fold line 30, (30') until it overlies the interior surface of the front panel 12, (12'). The second back side panel 56 (56') is folded about the fold line 60 (60') until it overlies the interior surface of the back panel 14, (14'). The glue flaps 34, 64, (34', 64') remain coplanar with the side panels 26, 56, (26', 56'), respectively. In this position, illustrated in FIG. 2, the glue areas 42, 72, (42', 72') on the glue flaps 34, 64, (34', 64'), respectively face upwardly.

Figure 2:
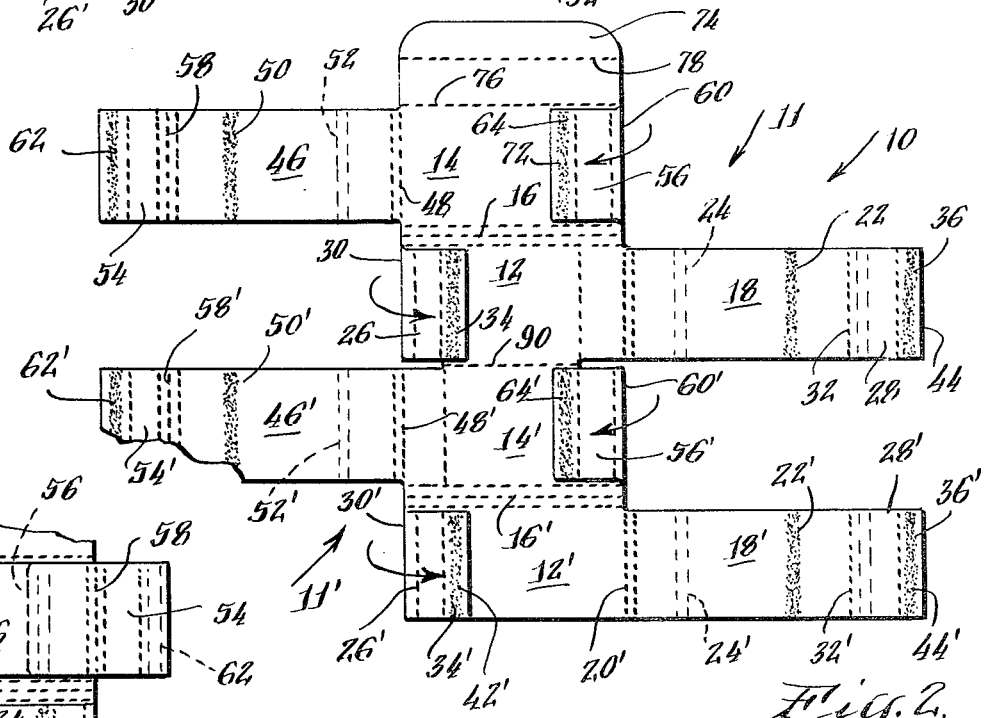
FIGS. 2, 3, 4, 6, 7 and 8 are plan and perspective views illustrating the blank of FIG. 1 in various stages of assembly.
Figure 3:
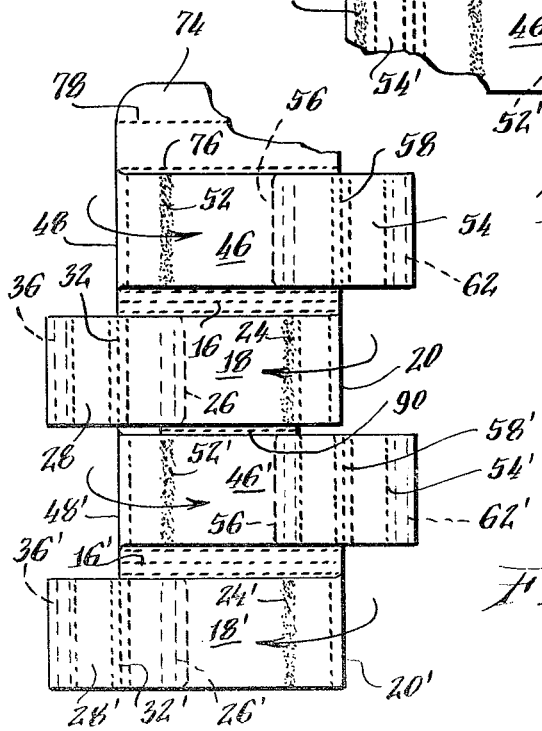

After the blank 10 has been folded to the configuration illustrated in FIG. 2, the front and back divider panels 28, 46, (28', 46') are folded. The front divider panel 18, (18') is folded about fold line 20, (20') to overlie the interior surface of the front panel 12, (12') and the first front side panel 26, (26') and the first front glue flap 34, (34') lying on such surface, as illustrated in FIG. 3. In this position, the glue area 22, (22') on the front divider panel 18, (18') mates with the glue area 42, (42') on the glue flap 34, (34'). The adhesive applied on the area 22, (22') and/or area 42, (42') affixes the glue flap 34, (34') and thereby the first front side panel 26, (26') to the exterior surface of the front divider panel 18, (18'). The back divider panel 46, (46') is folded about fold line 48, (48') to the position illustrated in FIG. 3 in which the back divider panel 46, (46') overlies the interior surface of the back panel 14, (14'), and the second back glue flap 64, (64') and second back side panel 56, (56') lying on such surface. In this position, the glue area 50, (50') of the back divider panel 46, (46') mates with the glue area 72, (72') on the glue flap 64, (64'). The adhesive applied on the area 50, (50') and/or area 72, (72') affixes the glue flap 64, (64') and thereby the second back side panel 56, (56') to the exterior surface of the back divider panel 46, (46').

In the FIG. 3 stage of assembly, the second front side panel 28, (28') and the second front glue flap 36, (36') remain coplanar with the front divider panel 18, (18'), while the second back side panel 54, (54') and the second back glue flap 62, (62') remain coplanar with the back divider panel 46, (46').

Figure 4:
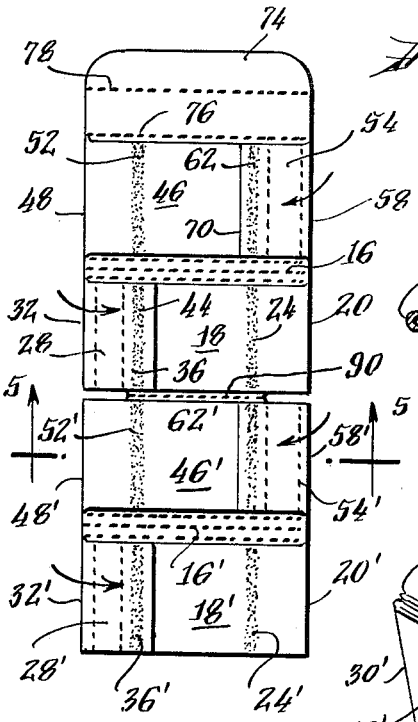
Figure 5:
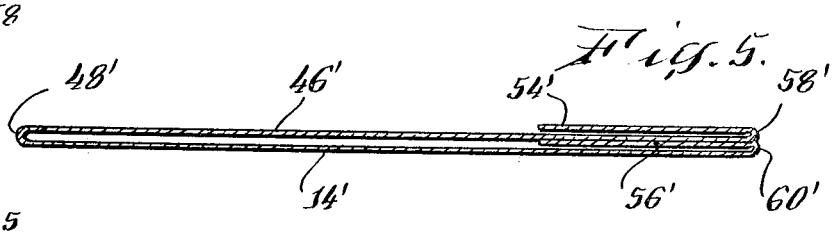
FIG. 5 is a cross-sectional view taken substantially along the plane indicated by lines 5—5 of FIG. 4.

As illustrated in FIG. 4, the second front side panel 28, (28') and the first back side panel 54, (54') are then folded. The second front side panel 28, (28') is folded about the fold line 32, (32') until the side panel 28, (28') and the glue flap 36, (36') overlie the interior surface of the front divider panel 18, (18'). The first back side panel 54, (54') is folded about the fold line 58, (58') until the first back side panel 54, (54') and the glue flap 62, (62') overlie the interior surface of the back divider panel 46, (46'). In this position illustrated in FIG. 4, the glue flaps 36, 62, (36', 62') remain coplanar with the side panels 28, 54, (28', 54'), respectively. Additionally, the glue areas 24, 40, 52, 70, (24', 40', 52', 70') are exposed.

Figure 6:
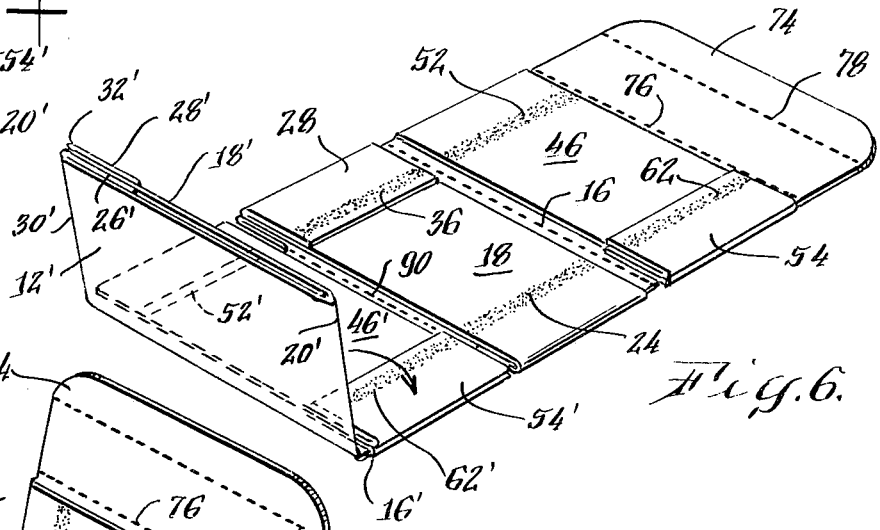
Figure 7:
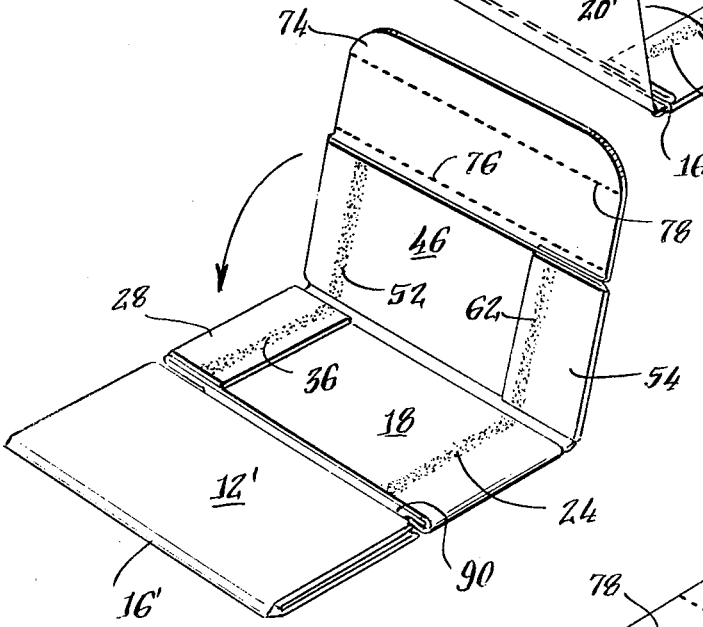
Figure 8:
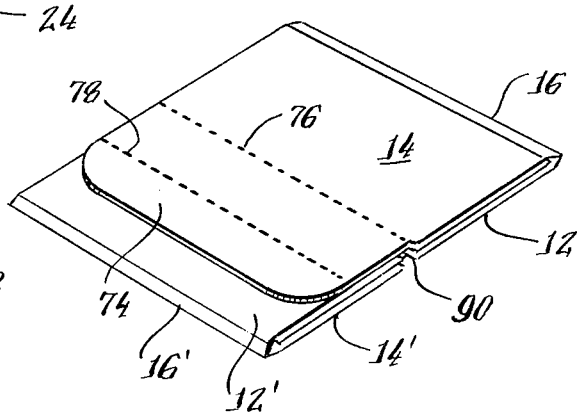

The assembly of the envelope 80 is completed as shown in FIGS. 6 to 8 by folding the panels 12, 18, 26, 28, (12', 18', 26', 28') and the flaps 62, 64, (62', 64') about the fold line 16, (16') between the front panel 12, (12') and the back panel 14, (14'). The folding along fold line 16, (16') causes the glue areas 44, 52, (44', 52') to mate and the glue areas 24, 70, (24', 70') to mate. The adhesive applied to the glue area 44, (44') and/or the glue area 52, (52') affixes the glue flap 36, (36') and thereby the second front side panel 28, (28') to the interior surface of the back divider panel 46, (46'). Similarly, the adhesive applied to the glue area 24, (24') and/or glue area 70, (70') affixes the glue flap 62, (62') and thereby the first back side panel 54, (54') to the interior surface of the front divider panel 18, (18'). The blank is then folded about fold line 90, 180° back upon itself to form the double, three-pocket envelope illustrated in FIGS. 9 to 11.

In the open and expanded configuration of the envelope 80 illustrated in FIGS. 9 to 11, the envelope 80 has two sets of three pockets 82, 84, 86 and 82', 84', 86'. The front pocket 82 (82') is defined between the front panel 12, (12') and the front divider panel 18, (18'). The middle pocket 84, (84') is defined between the divider panels 18, 46, (18', 46'). The back pocket 86, (86') is defined between the back panel 14 (14') and the back divider panel 46, (46').

The expandable nature of the envelope 80 is provided by the arrangement of the side panels and glue flaps, together with the hinged couplings of the front and back panels 12, 14, (12', 14') to the front and back divider panels 18, 46, (18', 46') respectively, provided at the lateral sides of the envelope 80. As illustrated in FIGS. 9 to 11, the front divider panel 18, (18') is hingedly coupled to the front panel 12, (12') along the fold line 20, (20') at one side edge of the front panel 12, (12'). The other side edge of the front panel 12, (12') is hingedly coupled to the front divider panel 18, (18') by means of the first front side panel 16, (16') and the first front glue flap 34, (34'). The front and back divider panels 18, 46, (18', 46') are hingedly coupled at one side by the second front side panel 28, (28') and second glue flap 36, (36') and at the other side by the first back side panel 54, (54') and the first back glue flap 62, (62'). The back panel 14, (14') is hingedly coupled to the back divider panel 46, (46') at one side along fold line 48, (48') and at the other side by the second back side panel 56, (56') and the second back glue flap 64, (64').

The fold lines between the side panels and the respective glue flaps facilitate folding therebetween during expansion of the envelope. This ensures folding at a predetermined location and avoids undue stress on the adhesive fixing the glue flaps to the respective surfaces of the divider panels 18, 46 (18', 46').

Once the desired articles have been located in one or more of the pockets 82, 84, 86, (82', 84', 86') the top flap 74 may be folded about the fold line 76 and/or one or more of the fold lines 78 to close the envelope 80 and protect the contents, as illustrated in phantom lines in FIG. 10.

The envelope 80 and the pockets 82, 84, 86, (82', 84', 86') therein may be formed of any desired shape. The maximum expansion of the pockets may be adjusted by varying the dimension of the side panels 26, 28, 54, 56, (26', 28', 54', 56') between its fold lines. The height and width of the envelope and the pockets therein may be varied by varying the appropriate dimensions of the panels 12, 14, 18, 46, (12', 14', 18', 46'). As indicated, the envelope 80 may be formed in multiples of three pockets, by use of one fold line or common edge 90 between each three-pocket segment.

By forming and folding the blank 10 and the envelope 80 in this manner, a multiple pocket expandable envelope may be easily and simply manufactured in a one-pass, right angle gluing and folding operation on conventional gluing and folding apparatus. Since the blank is unitary, the problems associated with accumulating and assembling a specific plurality of components are obviated.

While a particular embodiment has been chosen to illustrate the invention, it will be understood by those skilled in this art that various changes and modifications can be made therein without departing from the scope of the invention as defined in the appended claims.

What is claimed is:

1. A multiple pocket, expandable envelope formed from a planar, unitary blank, comprising at least two pair of:

(a) front and back panels having opposed end edges and opposed first and second side edges and being hingedly coupled at adjacent end edges thereof along a fold line;

(b) front and back divider panels each having opposed first and second side edges and opposed first and second surfaces, said front and back divider panels hingedly coupled at said first side edges thereof to said front and back panels, respectively, at said first side edges thereof along fold lines;

(c) first means hingedly coupling said front panel at said second side edge thereof to said front divider panel;

(d) second means hingedly coupling said front and back divider panels; and (e) third means hingedly coupling said back panel at said second side edge thereof to said back divider panel; the front panel of one of said pairs being hingedly coupled along a common end edge fold line to the back panel of the other of said pair.

2. A multiple pocket, expandable envelope according to claim 1, wherein said first means comprises:

a side panel hingedly coupled to said front panel along a fold line; and a flap coupled to said side panel at a side edge thereof remote fron said front panel, said flap fixed to said front divider panel first surface.

3. A multiple pocket, expandable envelope according to claim 2, where said side panel and said flap are hingedly coupled along a fold line.

4. A multiple pocket, expandable envelope according to claim 1, wherein said second means comprises:

first and second side panels hingedly coupled to said front and back divider panels, respectively, at said second side edges thereof along fold lines; and first and second flaps coupled to said first and second side panels, respectively, at side edges thereof remote from said front and back divider panels, respectively, said first and second flaps fixed to said back divider panel first surface and said front divider panel second surface, respectively.

5. A multiple pocket, expandable envelope according to claim 4, wherein said first and second side panels are hingedly coupled to said first and second flaps, respectively, along fold lines.

6. A multiple pocket, expandable envelope according to claim 1, wherein said third means comprises:

a side panel hingedly coupled to said back panel along a fold line; and a flap coupled to said side panel at a side edge thereof remote from said back panel, said flap fixed to said back divider panel second surface.

7. A multiple pocket, expandable envelope according to claim 6, wherein said side panel and said flap are hingedly coupled along a fold line.

8. A planar, unitary blank for forming a multiple pocket, expandable envelope, comprising at least two pairs of:

(a) front and back panels each having opposed end edges and opposed first and second side edges and being hingedly coupled at adjacent end edges thereof along a fold line;

(b) a front divider panel hingedly coupled at one of said front panel side edges along a fold line;

(c) first and second front side panels hingedly coupled at the other of said front panel side edges and at a side edge of said front divider panel remote from said front panel, respectively, along fold lines;

(d) a back divider panel hingedly coupled at one of said back panel side edges along a fold line; and (e) first and second back side panels hingedly coupled at a side edge of said back divider panel remote from said back panel and at the other of said back panel side edges, respectively, along fold lines;

the front panel of one of said pairs being hingedly coupled along a common end edge fold line to the back panel of the other of said pair.

9. A planar, unitary blank according to claim 8, further comprises:

first and second front glue flaps hingedly coupled to side edges of said first and second front side panels remote from said front panel along fold lines; and first and second back glue flaps hingedly coupled to side edges of said first and second back side panels remote from said back panel along fold lines.

10. A planar, unitary blank according to claim 8, wherein said first side edges are colinear and said second side edges are colinear, and said front and back divider panels are hingedly coupled to said front panel second side edge and said back panel first side edge, respectively.

11. A method of forming a multiple pocket, expandable envelope, comprising:

forming a planar, unitary blank with at least two pairs of:

front and back panels each having opposed end edges and opposed side edges and being hingedly coupled at adjacent end edges thereof along a fold line.

a front divider panel hingedly coupled at one of said front panel side edges along a fold line, first and second front side panels hingedly coupled at the other of said front panel side edges and at a side edge of said front divider panel remote from said front panel, respectively, along fold lines, a back divider panel hingedly coupled at one of said back panel side edges along a fold line, and first and second back side panels hingedly coupled at a side edge of said back divider panel remote from said back panel and at the other of said back panel side edges, respectively, along fold lines;

the front panel of one of said pairs being hingedly coupled along a common end edge fold line to the back panel of the other of said pair;

folding each of said first front side panel and each of second back side panel to overlie interior surfaces of each of said front and back panels, respectively, about the respective fold lines therebetween;

folding each of said front and back divider panels to overlie each of said front panel and first front side panel and each of said back panel and second back side panel, respectively, about the respective fold lines therebetween, and fixing each of said first front side panel and said second back side panel to adjacent surfaces of each of said front and back divider panels, respectively;

folding each of said second front side panel and said first back side panel to overlie interior surfaces of each of said front and back divider panels, respectively, about the respective fold lines therebetween;

folding each of said front and front divider panels relative to each of said back and back divider panels about the fold line between said front panel and said back panel, and fixing each of said second front side panel and said first back side panel to adjacent surfaces of each said back and front divider panels, respectively; and folding one of said pairs of front and back panels 180° relative to the other one of said pairs of front and back panels.

12. A method according to claim 11, wherein each of said side panels has a glue flap hingedly coupled thereto at a side edge thereof along a fold line; and wherein said glue flaps are fixed to the respective panels by an adhesive.

* * * * *